US005085240A

United States Patent [19]

Littledeer

[11] Patent Number: 5,085,240

[45] Date of Patent: Feb. 4, 1992

[54] SHELTER STRUCTURE

[76] Inventor: Tomislay F. Littledeer, 1961 Gertrude, Chambly, Quebec, Canada, J3L 4G8

[21] Appl. No.: 705,592

[22] Filed: May 24, 1991

[51] Int. Cl.[5] ..... E04H 15/48

[52] U.S. Cl. ..... 135/109; 135/113

[58] Field of Search ..... 135/109, 88, 113, 102, 135/107, 97; 52/64, 66

[56] References Cited

U.S. PATENT DOCUMENTS

| | | | |
|---|---|---|---|
| 2,023,813 | 12/1935 | Jolly | 135/118 X |
| 2,036,033 | 3/1936 | Fisher | 135/118 X |
| 3,152,707 | 10/1964 | Rey | 135/88 X |
| 4,106,520 | 8/1978 | Warner et al. | 135/109 X |
| 4,343,322 | 8/1982 | Fiddler | 135/109 X |
| 4,425,929 | 1/1984 | Von Mosshaim | 135/109 X |
| 4,716,919 | 1/1988 | Griffin | 135/88 X |

FOREIGN PATENT DOCUMENTS

| | | | |
|---|---|---|---|
| 790920 | 7/1968 | Canada | 135/88 |
| 1129754 | 8/1982 | Canada | 135/109 |
| 1476092 | 4/1989 | U.S.S.R. | 52/64 |
| 752911 | 7/1956 | United Kingdom | 52/64 |
| 2110261 | 6/1983 | United Kingdom | 135/107 |

*Primary Examiner*—3
*Assistant Examiner*—Lan Mai
*Attorney, Agent, or Firm*—Thomas N. Neiman

[57] ABSTRACT

A shelter structure comprising a supporting framework which includes a pair of spaced apart base members, each base member comprising a plurality of stationary receptacles. A plurality of ribs extend between the base members and have end portions removably mounted to respective stationary receptacles of the base members to form a skeleton frame which is covered by a skin. Each base member also comprises a movable receptacle capable to removeably hold the end portion of a rib. To erect the shelter, the ribs are temporarily mounted in the stationary receptacles of the base members to form a skeleton frame, the skin is mounted to the skeleton frame and one or more selected ribs which ultimately will form the door of the shelter structure are transferred from their respective stationary receptacles to movable receptacles so as to allow the ribs to move between an opened and a closed position relatively to the other ribs of the shelter.

13 Claims, 3 Drawing Sheets

SHELTER STRUCTURE

FIELD OF THE INVENTION

The invention relates to a general purpose shelter structure having a variety of applications such as garages, green-houses, tents, swimming pool shelters or the like. More specifically, the invention relates to a shelter structure which is easy to erect and has a movable section to allow access to the interior of the shelter structure. The invention also extends to an improved component of the shelter structure, more particularly a base member to hold in position a plurality of ribs forming the skeleton frame of the shelter structure.

BACKGROUND OF THE INVENTION

Temporary or collapsible shelters are widely used in a variety of fields because they can be erected considerably more rapidly than a permanent structure and then disassembled when no longer required. A specific example is the temporary garage for automobiles which is mostly used in northern regions where the climate is harsh during the winter. Such garages have a skeleton frame formed by a plurality of metallic ribs supporting a flexible skin that may be either a fabric or a sheet of synthetic material. Although these types of shelters are considerably easier to erect than permanent shelter structures built in a tradional fashion, the process of erecting the shelter is still time-consuming and often requires the assistance of more than one individual. In addition, conventional temporary shelters have rather awkward doors which are difficult to open. Typically, the door structure is simply a large flexible flap spanning the area defined by the front rib of the skeleton frame which forms the door opening of the shelter. The flap is maintained in a closed position by suitable fasteners such as strings. Due to its nature, this large flap is difficult to manipulate in order to close or open the shelter, especially in a strong wind condition. In addition, either in the closed or in the opened position, strong wind forces subject the flap to violent movements which may damage it.

OBJECTS AND STATEMENT OF THE INVENTION

An object of the present invention is a shelter structure which is relatively easy to erect by comparison to conventional temporary shelter structures. A more specific object of the invention is an improved component of the shelter structure which facilitates the ribs installation during the process of erecting the skeleton frame of the shelter structure.

Another object of the invention is a shelter with an improved door structure which facilitates the door opening and closing process and also is less subject to wind damage as in comparison to conventional shelters where the door is formed only by a substantially loose flexible flap.

In one aspect, the invention provides a shelter structure, comprising:

a supporting framework including a pair of spaced apart rib holders, each of the rib holders comprising a plurality of stationary receptacles;

a plurality of rib members radiating from said holders and extending therebetween to form a skeleton frame, the rib members having end portions removably mounted to respective stationary receptacles of the rib holders;

a flexible skin covering at least part of the skeleton frame; and a movable receptacle mounted for movement to each rib holder, the movable receptacle being capable to removably receive the end portions of a rib member, whereby to erect the shelter the rib members are mounted in the stationary receptacles of the base members to form the skeleton frame, the flexible skin is mounted to the skeleton frame and a selected rib member is transfered from the respective stationary receptacle to a movable receptacle allowing the selected rib member to move relatively to the supporting framework.

In another aspect, the invention provides a rib holder for use with a shelter structure, comprising:

an upstanding wall portion including a top edge;

a plurality of stationary receptacles on the top edge for removably receiving end portions of rib members forming a skeleton frame of the shelter structure;

a movable receptacle mounted for movement to a lateral face of the upstanding wall portion for removably receiving and end portion of a rib member.

Yet, in another aspect, the invention provides a shelter structure, comprising:

a supporting framework to support the shelter structure;

a plurality of rib members having opposite extremities retained to the supporting framework forming a skeleton frame;

a flexible skin covering at least part of the skeleton frame, at least one of the rib members being movable relatively to the supporting framework between a closed and an opened position, in the opened position said at least one of the rib members being in an overlapping relationship with the adjacent rib member and the flexible skin spanning a surface between the rib members in an overlapping relation assuming a folded condition.

BRIEF DESCRIPTION OF THE DRAWINGS

Further objects and features of this invention will become more apparent by reference to the following description taken in conjunction with the accompanying figures, in which.

DESCRIPTION OF PREFERRED EMBODIMENTS

Figure 1:
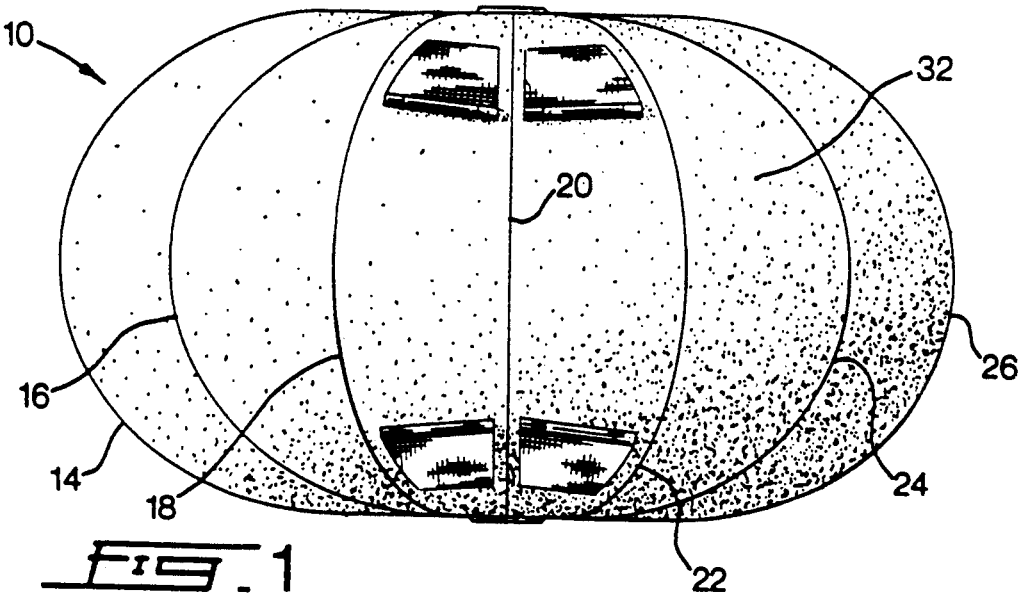
FIG. 1 is a top view of a collapsible shelter structure constructed in accordance with the present invention.
Figure 2:
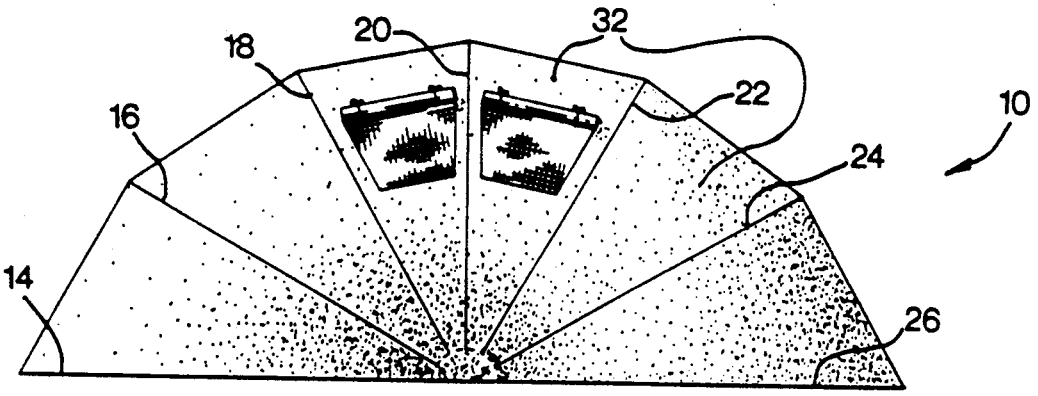
FIG. 2 is a side elevational view of the shelter structure shown in FIG. 2, its door being in the closed position.
Figure 3:
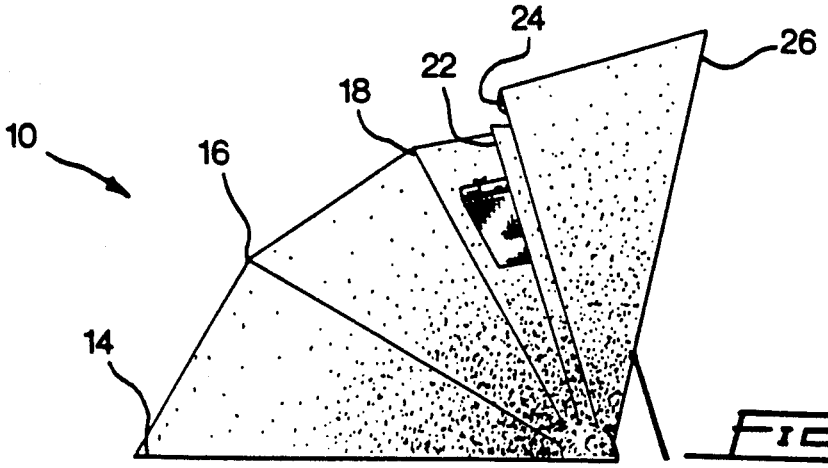
FIG. 3 is a view similar to FIG. 2 except that the door is in the opened position.

Referring to FIGS. 1, 2, 3 and 10, the shelter structure according to the invention is identified comprehensively by the reference numeral 10 and comprises a skeleton frame 12 constituted by rib members 14, 16, 18, 20, 22, 24 and 26. These rib members have opposite extremities retained into rib holders or hubs 28 and 30 which will be described in detail later, and form a generally dome-shaped structure which constitutes a support for a flexible covering 32. It will be appreciated that the ribs 14 and 26 in conjunction with the hubs 28 and 30, form a generally planar and wide footing system for the entire structure. If desired, the stability of the footing system may be enhanced by providing either ballast members or simply by anchoring the various components of this footing system into the ground or the surface on which it is mounted.

The structure of the ribs 14 to 26 is not critical to the invention. These ribs may be of a unitary construction or a multi-component assembly and various materials may be used for their manufacture such as plastic, metal or others. In a preferred embodiment, each rib is made of two sections of galvanized metallic pipe which offers durability, strength and the resistance to corrosion, that are joined at the apex of the rib in a manner to allow a certain degree of pivotal motions in the rib plane. Such a joint may be constituted either by a hinge or simply by a loosely tightened bolt passing between overlapping extremities of the two rib sections. The joint may be covered by a weather resistant rubber boot.

It will be appreciated that the various rib members of the skeleton frame 12 are of a similar shape however they defer in size. More particularly, the top rib 20 is the smallest, the remaining ribs increasing in size progressively downwardly, so that each rib, with the exception of the end ribs 14 and 26, is capable to receive in an overlapping relationship any one of the preceding ribs. The importance of this characteristic will become clear as the description proceeds. This difference in size of the rib members gives to the shelter structure a somewhat flattened dome-shape.

Figure 4:
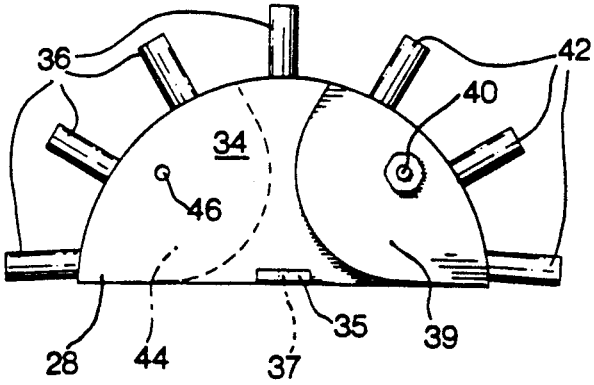
FIG. 4 is an enlarged side elevational view of a rib holder used for supporting one extremity of the ribs forming the skeleton frame of the shelter structure.
Figure 5:
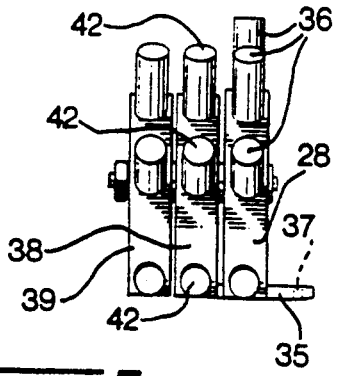
FIG. 5 is a front view of the rib holder shown in FIG. 4.

The hubs 28 and 30 which are identical are best illustrated in FIGS. 4 to 9. FIGS. 4 and 5 show a first variant of the hub comprising a generally semicircular upstanding and flat wall portion 34 which may be made of any suitable material such as plastic or metal having the required strength and resistance characteristics. A corrosion resistant material is strongly preferred because of its durability in northern climates. On the top edge of the upstanding wall portion 34 are secured seven radially extending receptacles 36 for receiving the extremities of rib members 14 to 26. The receptacles 36 are in the form of nipples adapted to be used with ribs of tubular construction, slidingly fitting in the respective rib ends. In the embodiment illustrated in FIG. 4, the nipples are equally spaced apart at 30. When the footing structure is deposited on the ground, the free play in the joints between the ribs and the receptacles will allow the ribs to become coplanar but will prevent them to move further in the upward direction. This characteristic has the effect of providing a more stable footing system which is substantially free of free-play that may cause some instability when installed on the ground. By comparison, if the end sockets were formed perfectly horizontal, the free-play between the sockets and the ribs would remain when the structure is positioned on the ground surface and may result in an undesirable wobbling of the entire shelter.

A pair of plates 38 and 39 are pivotally mounted at 40 to the upstanding wall portion 34, each comprising radially projecting receptacles 42 which are identical in construction to the receptacles 36. It will be appreciated that the receptacles 42 are laterally spaced apart from the receptacles 36. In addition, the receptacles 42 are, by virtue of the pivotal connection 40, free to move relatively to the receptacles 36.

A pair of plates 44 and 45, identical in construction to the plates 38 and 39, can also be provided on the other face of the upstanding wall portion 34 and mounted thereto by a pivot 46.

The upstanding wall portion 34 is supported on a horizontally extending flange 35 provided with a pair of holes 37 and 29 for receiving screws, bolts or other fasteners to secure the hub on a supporting surface. The bottom face of the flange 35 is slightly convex so as to allow a certain degree of rolling motion as a result of tightening of one of the bolts received in the holes 37 and 39. In turn, this rolling motion will vary the inclination of the upstanding wall portion 34, to either stretch or compress the ribs of the skeleton frame. This adjustment is useful because it allows to build in the skeleton frame a certain tension to resist wobbling.

Variants of the hub are illustrated in FIGS. 6 to 9. However, before a detailed description of their structure is provided, the operation of the shelter structure according to the invention will be described to illustrate in more detail the operation of the hub.

The shelter structure 10 is assembled by mounting the various rib members to the hubs 28 and 30. If the rib members are of a tubular construction, this is achieved by slipping the extremity of each rib member in a receptacle 36. Although not shown in the drawings, a locking device may be provided to prevent an unwanted removal of the rib from the receptacle, such as a cutter pin for example. Since the receptacles 36 are stationary, the installation of the rib members is a relatively easy operation and in most instances, it can be performed by one individual. Evidently, for large shelter structures, two persons may be required.

By moving the hubs 28 and 30 relatively to one another and also by varying the inclination of each hub as indicated earlier, the shape of skeleton frame may be changed, by virtue of the hinge connection in each rib. For example, by bringing the hubs 28 and 30 closer to one another, the skeleton frame will be narrowed and its height will be increased. By moving the hubs away from one another, the opposite effect will be obtained.

Figure 10:
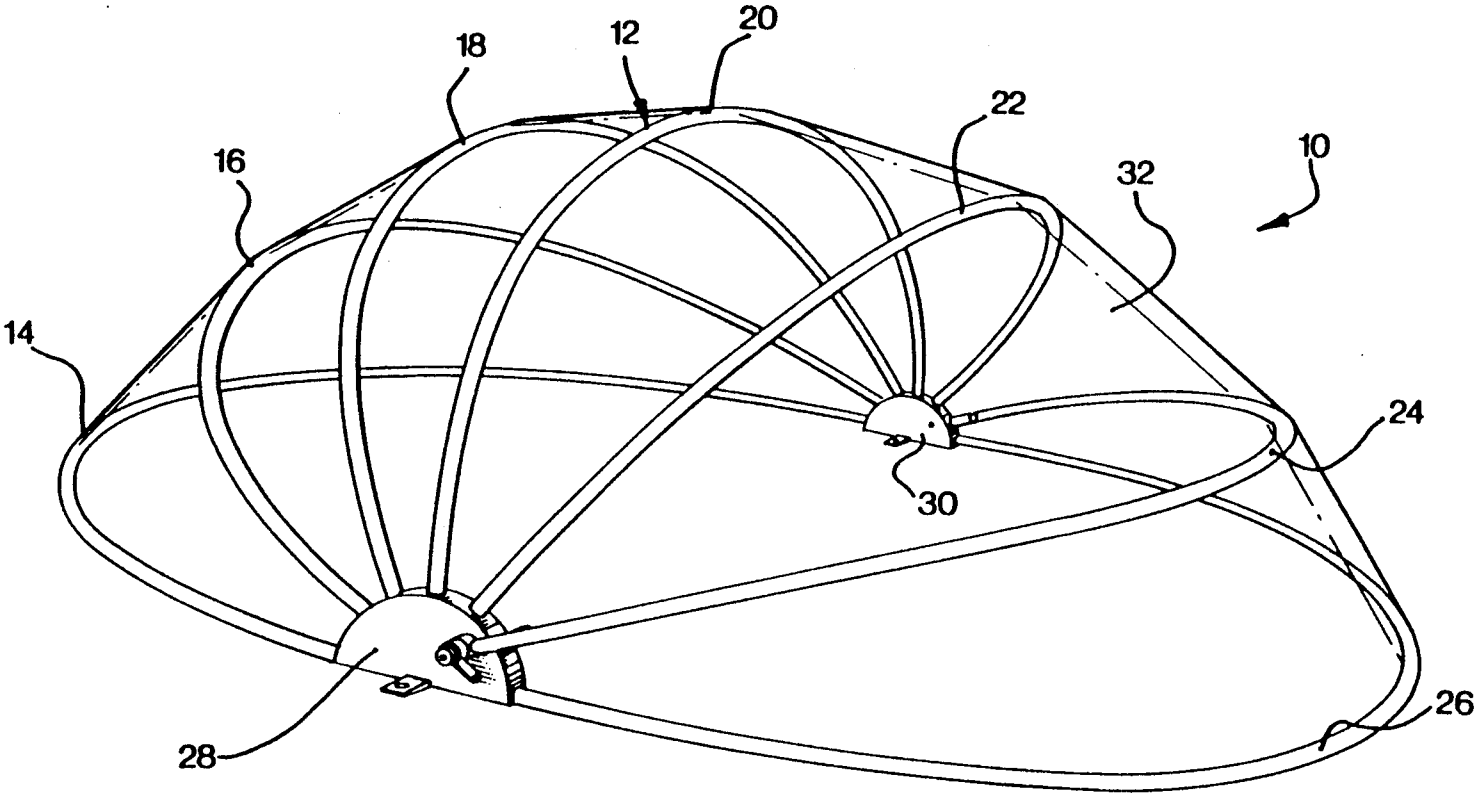
FIG. 10 is a perspective view of the shelter structure having a transparent flexible skin showing the skeleton frame of the shelter structure.

When all the ribs have been located in the base members 28 and 30 so as to form a skeleton frame 12 shown in FIG. 10, the skin 32 is installed thereon. The skin 32 may be of any suitable construction, such as fabric or plastic material, and it will normally be secured to the individual ribs such as by eyelets so as to remain securely in place on the skeleton frame 12. It is not deemed to be necessary to described in detail the attachment system of the flexible skin 32 to the skeleton frame 12 as such systems are well known to those skilled in the art. In a variant, a rigid skin may be provided for some sections of the shelter which do not fold. The next step of the shelter assembly process consists of locating at least one of the ribs of the shelter structure in movable receptacles 42 of the hubs 28 and 30. For example, the rib 26 may be made movable simply by transferring its end portions from the respective receptacles 36 to the receptacles 42 of the pivotable plates 39. As a result, it will be possible to pivotally move the rib 26 toward the rib 24 in order to open the enclosure defined by the shelter structure 10.

Since the rib members of the skeleton frame are made larger in size from the central rib 20 toward the ribs 14 and 26, the rib 26 will be able to assume an overlapping relationship with the previous rib 24, in which case the flexible skin 32 spanning the surface between the ribs will adopt a folded condition. It will be appreciated that this method of opening the enclosure defined by the shelter structure 10 is particularly advantageous because at all times, the edges of the flexible skin are retained to the respective rib members against movement created by wind forces. In addition, the opening procedure is greatly simplified as it simply suffices to pivot the movable rib member in the required direction either upwardly to open the shelter or downwardly to close it.

In a variant, the rib 24 can be transferred to the pivotable plate 38, whereby it will be possible to move the ribs 24 and 26 relatively to the hubs 28 and 30 and also relatively to one another, since they are mounted to different pivotable plates.

Therefore, it will be appreciated that the invention is not limited to a system which uses only one movable rib member as the hubs 28 and 30 are provided to accomodate more than one rib member on the movable plates 38, 39, 44 and 45, so that entire sections of the shelter structure may be made movable. Referring momentarily to FIGS. 4 and 5, it will be seen that the pivotable plates 38, 39, 44 and 45 are provided each with three sockets 42 so as to accept three rib extremities. More specifically, the plate 38 can receive the extremities of the ribs 22, 24 and 26 and similarly, the plate 44 receive the extremities of ribs 14, 16 and 18. In that assembly, the shelter will be provided with two openable sections, each section being constituted by three ribs and the associated portion of the flexible skin 32. By placing ribs of an openable section in different pivotable plates, the section may be made folding or telescopic, as expressed earlier.

While each of the plates 38, 39, 44 and 45 is provided with three receptacles 42, they do not have to be necessarily all used. For example, only one or two ribs may be mounted to the movable plate and the remaining receptacles or socket left free.

Figure 6:
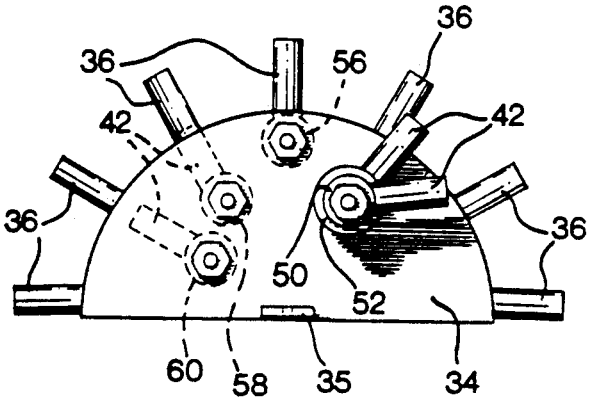
FIG. 6 is a side elevational view of the rib holder according to a variant.
Figure 7:
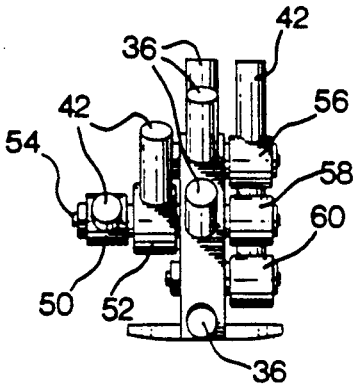
FIG. 7 is a front view of the rib holder shown in FIG. 6.

In a variant illustrated in FIGS. 6 and 7, the hub is provided on one side of the upstanding wall portion 34 with a pair of coaxial arms 50 and 52 each having a receptacle 42 and being mounted to the upstanding wall portion 34 by a common pivot 54. On the opposite face of the upstanding wall portion 34 are pivotally mounted individual arms 56, 58 and 60 each carrying a receptacle 42. This arrangement is advantageous because it permits to collapse the shelter structure 10 without the necessity of removing all of the ribs from the hubs 28 and 30. To collapse the structure, it suffices to remove the rib 26 which forms one section of the footing system, or to disconnect the flexible skin 32 from the rib 26 so that the ribs 16, 18, 20, 22 and 24 can be pivoted toward the rib 14, together with the flexible skin, thus folding the skeleton frame. The flexible structure can be reassembled simply by pulling on the flexible skin to unfold the skeleton frame and to place the ribs back into their original position.

Figure 8:
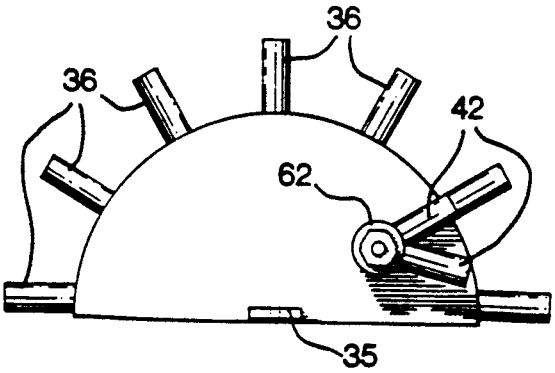
FIG. 8 is a side elevational view of a rib holder according to a further variant.
Figure 9:
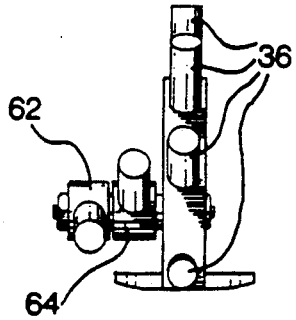
FIG. 9 is a front view of the rib holder shown in FIG. 8.

FIG. 8 is a further variant of the base member which is a simplified version of the variant shown in FIGS. 6 and 7. More particularly, this variant uses only a pair of coaxial arms 62 and 64 so as to allow only the ribs 24 and 22 to move relatively to one another and with relation also to the remaining portion of the shelter structure.

It will be appreciated that the flexible skin should be made somewhat wider at the base to accomodate the rib transfer from stationary to movable receptacles. In addition, it is preferred to extend the skin fully to the ground so as to form a skirt which will cover the hubs 28 and 30, protecting them against accumulation of debris which may interfere with the proper operation of this mechanical system.

While I have described my invention in connection with specific embodiments thereof, it is to be clearly understood that this is done only by way of example and not as a limitation to the scope of my invention as set forth in the objects thereof and in the appended claims.

I claim:

1. A shelter structure, comprising:

a supporting framework including a pair of spaced apart rib holders, each of said rib holders comprising a plurality of stationary receptacles;

a plurality of rib members radiating from said rib holders and extending therebetween to form a skeleton frame, said rib members having end portions removably mounted to respective stationary receptacles of said rib holders;

a flexible skin covering at least part of said skeleton frame; and a movable receptacle mounted for movement to each rib holder, the movable receptacle being capable to removably receive the end portions of a rib member, whereby to erect said shelter said rib members are mounted in stationary receptacles of said rib holders to form said skeleton frame, said flexible skin is mounted to said skeleton frame and a selected rib member is transfered from respective stationary receptacles to movable receptacles allowing the selected rib member to move relatively to said supporting framework.

2. A shelter structure as defined in claim 1, wherein:

said selected rib member is movable between an opened and closed positions, in said opened position said rib member being in at least a partially overlapping relationship with an adjacent rib member and a portion of said flexible skin spanning a surface between said selected and adjacent rib members being in a folded condition.

3. A shelter structure as defined in claim 1, comprising:

a plurality of movable receptacles mounted to each rib holder to allow a section of said shelter structure including a plurality of rib members to move relatively to a non-movable section of said shelter structure.

4. A shelter structure as defined in claim 1, wherein:

each rib holder includes an upstanding wall portion having a top edge which comprises said stationary receptacles, said movable receptacle being mounted to a lateral face of said wall portion.

5. A shelter structure as defined in claim 4, wherein:

said movable receptacle is pivotally mounted to said lateral face.

6. A shelter structure as defined in claim 5, comprising:

a plurality of movable receptacles coaxially and pivotally mounted to said lateral face.

7. A shelter structure as defined in claim 5, comprising:

a plurality of movable receptacles pivotally mounted to said lateral face at different locations thereon.

8. A shelter structure as defined in claim 4, wherein:

said upstanding wall portion is generally semi-circular in shape.

9. A shelter structure as defined in claim 8, wherein:

said stationary receptacles project radially from said top edge.

10. A shelter structure as defined in claim 4, wherein:

each base portion comprises a supporting flange from which projects said upstanding wall portion, said supporting flange being generally at a right angle to said upstanding wall portion.

11. A shelter structure as defined in claim 10, wherein:

said supporting flange comprises a generally convex bottom face and fastener receiving means on either side of said upstanding wall portion, whereby an inclination of said upstanding wall portion may be controlled by adjusting a fastener received in said fastener receiving means to cause a controlled rolling movement of said base member on said bottom face.

12. A base member for use with a shelter structure, comprising:

an upstanding wall portion including a top edge;

a plurality of stationary receptacles on said top edge for removably receiving end portions of rib members forming a skeleton frame of the shelter structure;

a movable receptacle mounted for movement to a lateral face of said upstanding wall portion for removably receiving and end portion of a rib member.

13. A shelter structure, comprising:

a supporting framework to support said shelter structure;

a plurality of rib members having opposite extremities retained to said supporting framework, forming a skeleton frame;

a flexible skin covering at least part of said skeleton frame, at least one of said frame members being movable relatively to said supporting framework between a closed and an opened position, in said opened position said at least one of said rib members being in an overlapping relationship with an adjacent rib member and said flexible skin spanning a surface between the rib members in an overlapping relation assuming a folded condition;

said supporting framework being substantially planar and comprising a pair of horizontally spaced apart rib holders receiving respective extremities of said plurality of rib members;

each of said rib holders comprising an upstanding body including a plurality of radially extending receptacles receiving therein respective extremities of said rib members mounted to said rib member;

said upstanding body comprising a plurality of stationary receptacles and at least one movable receptacle to allow said at least one of said rib members to move between said open opened position and said closed position; and said movable receptacle comprising an arm pivotally mounted to said upstanding body.

* * * * *